US008640511B1

(12) United States Patent
Derman

(10) Patent No.: US 8,640,511 B1
(45) Date of Patent: Feb. 4, 2014

(54) LOW PROFILE LOCK INTERFACE SYSTEM AND METHOD

(76) Inventor: Jay S. Derman, Torrance, CA (US)

( * ) Notice: Subject to any disclaimer, the term of this patent is extended or adjusted under 35 U.S.C. 154(b) by 41 days.

(21) Appl. No.: 13/355,328

(22) Filed: Jan. 20, 2012

Related U.S. Application Data

(63) Continuation-in-part of application No. 13/270,439, filed on Oct. 11, 2011, now abandoned.

(60) Provisional application No. 61/533,898, filed on Sep. 13, 2011.

(51) Int. Cl.
*E05B 69/00* (2006.01)
*E05B 73/00* (2006.01)

(52) U.S. Cl.
USPC ..... 70/58; 70/33; 70/232; 70/386

(58) Field of Classification Search
USPC ..... 70/14, 18, 30–34, 49, 54–58, 232, 386, 70/DIG. 57; 248/551–553; 285/276, 277
See application file for complete search history.

(56) References Cited

U.S. PATENT DOCUMENTS

| | | | | | |
|---|---|---|---|---|---|
| 4,751,831 | A * | 6/1988 | Morris et al. | ..... | 70/159 |
| 5,066,049 | A * | 11/1991 | Staples | ..... | 285/80 |
| 5,992,187 | A | 11/1999 | Derman | | |
| 6,081,974 | A | 7/2000 | McDaid | | |
| 6,317,936 | B1 | 11/2001 | McDaid | | |
| 6,360,405 | B1 | 3/2002 | McDaid | | |
| 6,672,115 | B2 | 1/2004 | Wyers | | |
| 6,793,081 | B1 | 9/2004 | Derman | | |
| 7,165,426 | B2 | 1/2007 | Wyers | | |
| 7,225,649 | B2 | 6/2007 | Wyers | | |
| 7,997,106 | B2 | 8/2011 | Mahaffey et al. | | |
| 8,001,812 | B2 | 8/2011 | Mahaffey et al. | | |
| D646,951 | S | 10/2011 | Tsai | | |
| 8,074,478 | B1 | 12/2011 | Shu | | |
| 8,107,236 | B2 * | 1/2012 | Lin | ..... | 361/679.57 |
| 8,151,604 | B2 * | 4/2012 | Thomas et al. | ..... | 70/14 |
| 2003/0196462 | A1 * | 10/2003 | Chen | ..... | 70/49 |
| 2006/0086160 | A1 * | 4/2006 | Marszalek et al. | ..... | 70/58 |
| 2007/0157680 | A1 * | 7/2007 | DeMartinis et al. | ..... | 70/57 |
| 2010/0170304 | A1 * | 7/2010 | Anderson | ..... | 70/21 |
| 2011/0005281 | A1 * | 1/2011 | Lin | ..... | 70/58 |
| 2011/0061427 | A1 * | 3/2011 | Mahaffey et al. | ..... | 70/58 |
| 2011/0089794 | A1 | 4/2011 | Mahaffey et al. | | |
| 2012/0017656 | A1 * | 1/2012 | Senatori | ..... | 70/58 |

OTHER PUBLICATIONS

Reese Towpower 7006000 Stainless Steel Dual Bent Pin Receiver Lock, http://www.amazon.com, pp. 1-5, accessed Aug. 31, 2011.

* cited by examiner

*Primary Examiner* — Lloyd Gall
*Assistant Examiner* — Richard G Davis
(74) *Attorney, Agent, or Firm* — Aaron P. McGushion

(57) ABSTRACT

A system for securing an item to an anchor is disclosed. The system may include a first extension extending from an item, an interface mechanism connected to the first extension, and a lock. The interface mechanism may include a cylindrical base, a sleeve, and a second extension. The cylindrical base may comprise an extension aperture receiving the first extension therewithin. The slide may surround at least a portion of the cylindrical base and occupy a blocking position locking the first extension within the extension aperture. The second extension may extend from the slide and comprise a traveler occupying a locking position locking the slide in the blocking position. The lock may engage the second extension and lock the traveler in the locking position.

15 Claims, 7 Drawing Sheets

LOW PROFILE LOCK INTERFACE SYSTEM AND METHOD

RELATED APPLICATIONS

This application: (1) claims the benefit of U.S. Provisional Patent Application Ser. No. 61/533,898 filed Sep. 13, 2011; and (2) is a continuation-in-part of U.S. patent application Ser. No. 13/270,439 filed Oct. 11, 2011 now abandoned. Both U.S. Provisional Patent Application Ser. No. 61/533,898 and U.S. patent application Ser. No. 13/270,439 are hereby incorporated by reference.

BACKGROUND

1. The Field of the Invention

This invention relates to security systems and, more particularly, to novel systems and methods for tethering personal property to an anchor.

2. The Background Art

As computers, expensive electronic equipment, and other valuable portable articles have become more common, theft of such articles has increased. There are a number of different devices on the market to deter such theft. However, most of these devices are either bulky, so that they are not particularly portable, or they relay on certain clearances. Accordingly, what is needed is an improved, low profile system and method for securing valuable portable articles.

BRIEF SUMMARY OF THE INVENTION

In view of the foregoing, in accordance with the invention as embodied and broadly described herein, a method and apparatus are disclosed in one embodiment of the present invention as including a system protecting an item from theft or unwanted removal. In selected embodiments, a system may include a lock, an anchor, and an interface mechanism. An interface mechanism may be connected to an extension extending from an item (e.g., valuable portable article). A lock may selectively engage an interface mechanism and extend therefrom to engage an anchor, thereby forming a secure tie or link from the item to the anchor.

In selected embodiments, an interface mechanism may include a base and a slide. A base may include an extension aperture formed therein. An extension aperture may be sized and shaped to receive therewithin an extension (e.g., an anchor extending from the item to be secured). To selectively secure an extension within an extension aperture, an interface mechanism may include one or more interference members. An interference member may extend to engage an extension and, thereby, resist the removal of the extension from the interface mechanism.

In certain embodiments, a base may include one or more interference apertures. Each interference aperture may contain, or partially contain, a corresponding interference member. Each interference member may extend from a corresponding interference aperture to engage an extension.

A slide may be configured to travel with respect to a base. For example, a slide may be configured to translate in the axial direction with respect to a corresponding base. In selected embodiment, a slide may move between one or more blocking positions and one or more non-blocking positions. In a blocking position, a slide may block an interference member from moving out of engagement with an extension. Accordingly, when a slide is in a blocking position, an interface mechanism may be secured to a corresponding extension.

In a non-blocking position, a slide may permit an interference member to move within the corresponding interference aperture. Accordingly, with a slide in a non-blocking position, an interference member may move out of engagement with an extension. Accordingly, when a slide is in a non-blocking position, an interface mechanism may be easily removed from a corresponding extension.

In selected embodiments, an interface mechanism may include a second extension. A second extension, slide, or both may include a traveler aperture formed therein. A traveler aperture may be sized and shaped to receive a traveler therewithin. A traveler may selectively move between one or more locking positions and one or more non-locking positions.

In a locking position, a traveler may extend to engage a base. Accordingly, when a traveler is in a locking position, an interface mechanism may be secured to (e.g., locked into) a corresponding first extension. In a non-locking position, a traveler may enable a slide to move with respect to a corresponding base. Accordingly, with a traveler in a non-locking position, a slide may move with respect to a base until one or more interference members are able to move out of engagement with a first extension. Accordingly, when a traveler is in a non-locking position, an interface mechanism may be easily removed from a corresponding item.

A traveler and second extension may form, when the traveler occupies certain positions (e.g., a locking position), a composite configuration, profile, or shape that is compatible with a lock. Accordingly, in such embodiments, when a lock engages a second extension, the lock may contact a traveler and prevent it from moving away from a base. As a result, a lock may confine a traveler to one or more locking positions.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
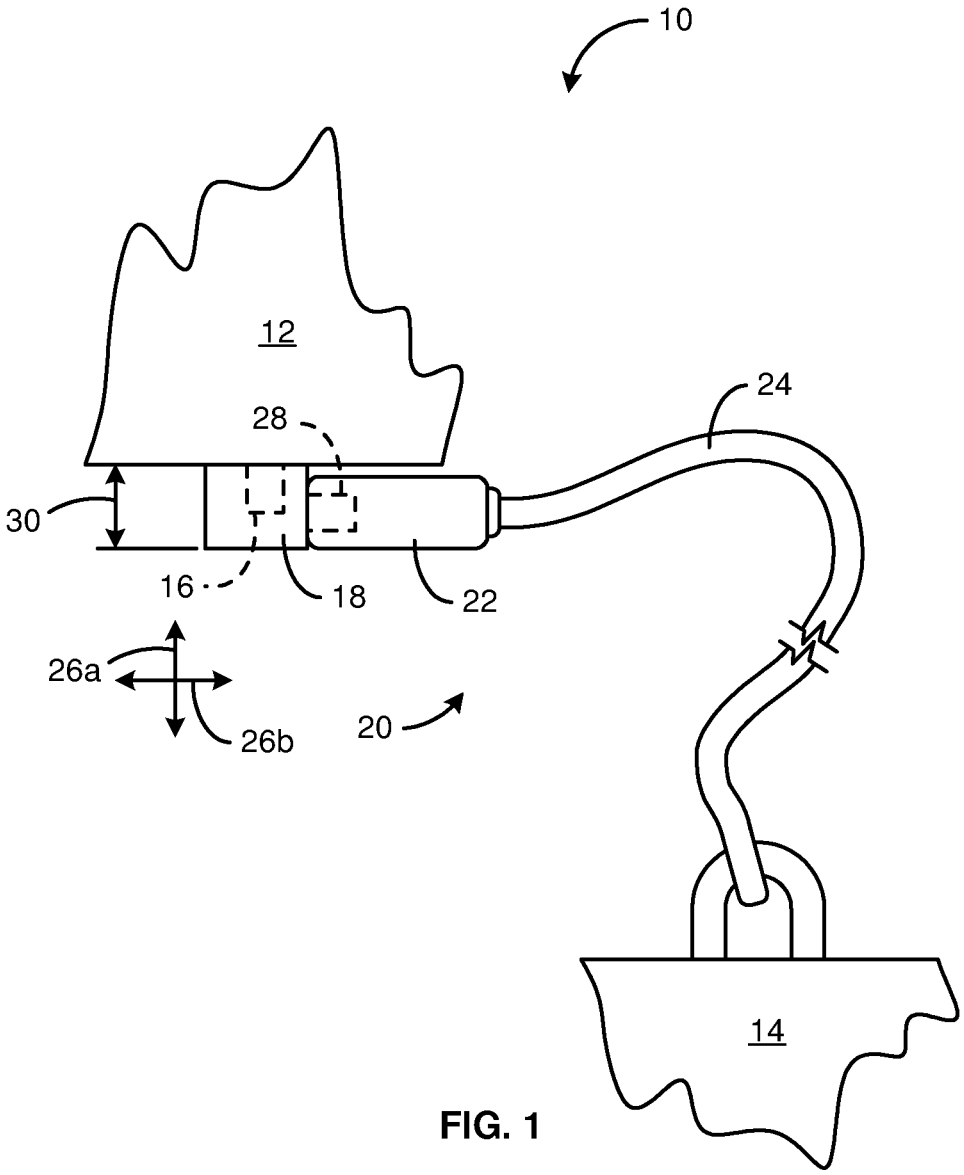
FIG. 1 is a schematic diagram of one embodiment of a system for securing an item in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a system 10 in accordance with the present invention may protect an item 12 (e.g., valuable portable article, laptop computer, digital music player, camera, or the like) from theft, unwanted removal, unauthorized use, or the like. In selected embodiments, this may be done by tethering an item 12 to an anchor 14. An anchor 14 may be an object that is substantially fixed in place (e.g., an embedded post or the like). Alternatively an anchor 14 may be an object sufficiently heavy, bulky, or both to rendering moving the object unpractical or undesirable. For example, an anchor 14 may comprise a desk, table, or the like that may be moved or dismembered, but only with significant effort or with the generation of unwanted attention from surrounding individuals.

In selected embodiments, an item 12 may include a first extension 16 extending therefrom. In such embodiments, a system 10 may include an interface mechanism 18 configured to receive and retain a first extension 16. A lock 20 may selectively (e.g., releasably) engage an interface mechanism 18 and extend therefrom to engage an anchor 14. In certain embodiments, a lock 20 may include a locking mechanism 22 and a flexible tether 24.

A locking mechanism 22 may be configured to selectively engage an interface mechanism 18. A locking mechanism 22 may prevent an interface mechanism 18 from releasing a corresponding first extension 16. A flexible tether 24 may comprise chain, cable, or the like. In selected embodiments, a flexible tether 24 may secure to a locking mechanism 20 and extend therefrom to engage (e.g., loop through or around) an anchor 14.

In certain embodiments, a lock 20 may be configured as or comprise a device disclosed in U.S. Pat. No. 6,081,974 issued Jul. 4, 2000, U.S. Pat. No. 6,317,936 issued Nov. 20, 2001, U.S. Pat. No. 6,360,405 issued Mar. 26, 2002, U.S. Pat. No. 7,997,106 issued Aug. 16, 2011, or U.S. Pat. No. 8,001,812 issued Aug. 23, 2011, each of which is hereby incorporated by reference. For example, a lock 20 may be configured as or comprise a device currently being sold by Kensington Computer Products Group under the CLICKSAFE trademark.

In selected embodiments, an interface mechanism 18 may enable a lock 20 to connect a first extension 16 in a confined space. That is, in certain situations or applications, a lock 20 or locking mechanism 22 that directly engages a first extension 16 may extend away from an item 12 too far in a first direction 26*a*. Accordingly, in such situations or applications, an interface mechanism 18 may engage the first extension 16 and present a second extension 28. The second extension 28 may extend in a direction different than the first extension 16 (e.g., in a second direction 26*b* angled with respect to the first direction 26*a*, orthogonal to the first direction 26*a*, or the like). Accordingly, the space 30 consumed by an interface mechanism 18 and locking mechanism 22 may be controlled or minimized and a lock 20 may engage the second extension 28 without extending into restricted space.

The various components of a system 10 in accordance with the present invention may be formed of any suitable materials. Suitable materials may be selected to provide a desired durability, strength, rigidity, toughness, or the like. For example, in selected embodiments, one or more of the components of an interface mechanism 18 may be formed of a polymer material. However, in other embodiments where greater stresses are expected, such components may be formed of a metal or metal alloy.

Figure 2:
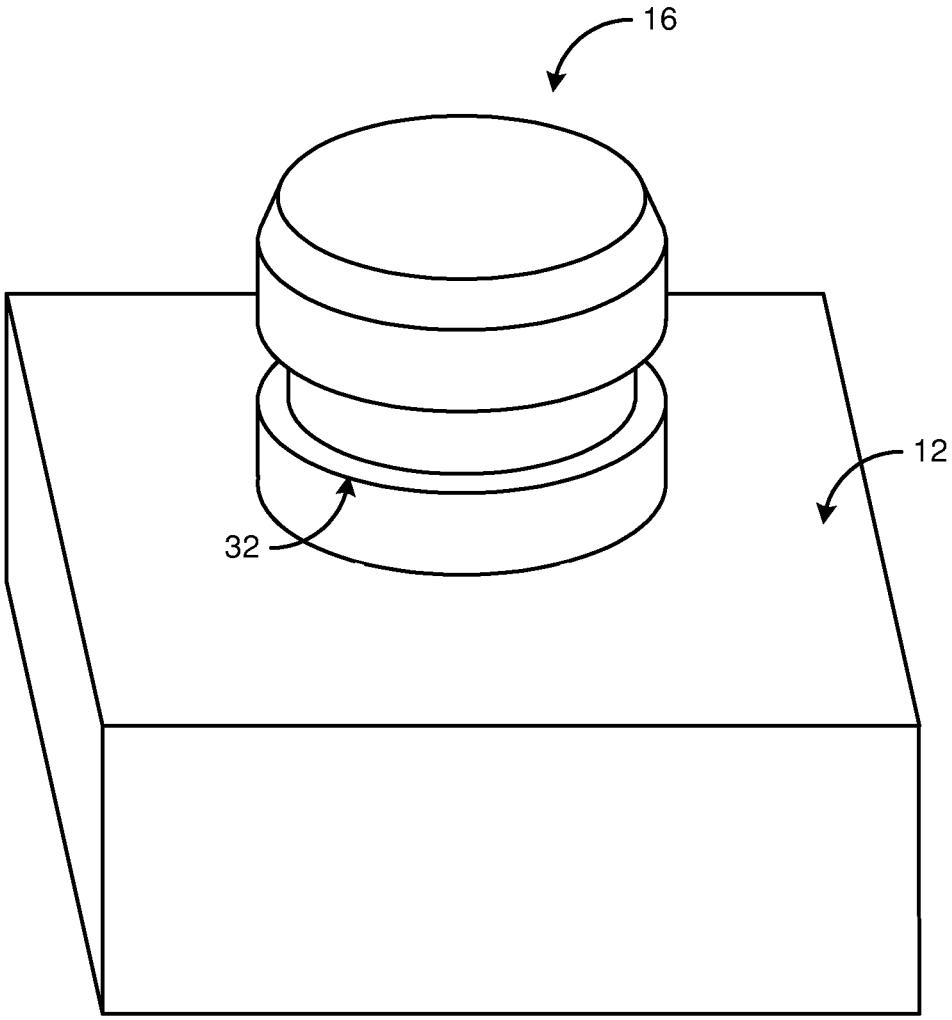
FIG. 2 is a perspective view of one embodiment of an extension in accordance with the present invention.

Referring to FIG. 2, first and second extensions 16, 28 in accordance with the present invention may have any suitable configuration or combination of configurations. For example, a first extension 16 may connect to, or extend from, an item 12 in any suitable manner. In certain embodiments, a first extension 16 and one or more portions of a second extension 28 may be configured as an anchor disclosed in U.S. Pat. No. 6,081,974, U.S. Pat. No. 6,317,936, or U.S. Pat. No. 6,360,405. Alternatively, a first extension 16 and one or more portions of a second extension 28 may be configured as an attachment device disclosed in U.S. Pat. No. 7,997,106 or U.S. Pat. No. 8,001,812. In still other embodiments, a first extension 16 may be configured as an interface mechanism disclosed in U.S. patent application Ser. No. 13/216,076 filed Aug. 23, 2011, which is hereby incorporated by reference.

In selected embodiments, first and second extensions 16, 28 may each include one or more mechanisms enabling a corresponding structure to engage therewith. For example, a first extension 16 may include a locking groove 32 enabling an interface mechanism 18 to selectively grip the first extension 16. Similarly, a second extension 28 may include a locking groove 32 enabling a locking mechanism 22 to selectively grip the second extension 28. In certain embodiments, a locking groove 32 may extend circumferentially about an extension 16, 28. Such a locking groove 32 may enable a corresponding interface mechanism 18 or locking mechanism 22 to pivot about the extension 16, 28, while maintaining a secure engagement therewith.

Figure 3:
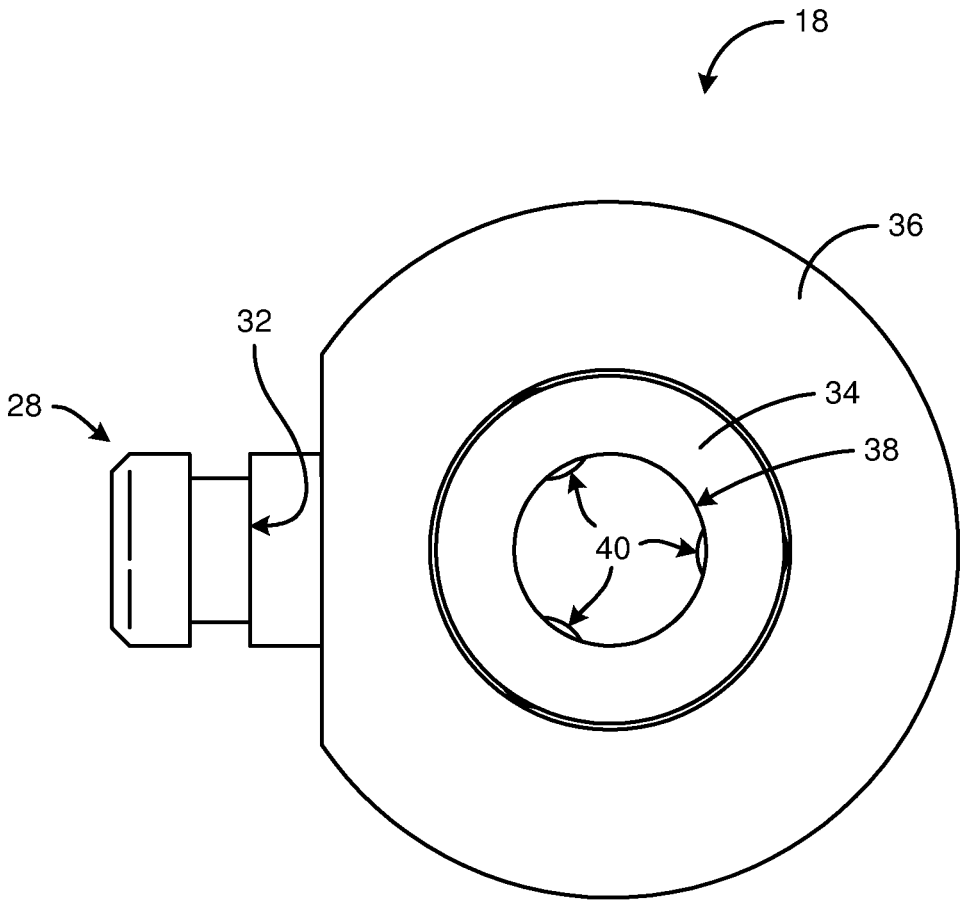
FIG. 3 is a bottom view of one embodiment of an interface mechanism in accordance with the present invention.
Figure 4:
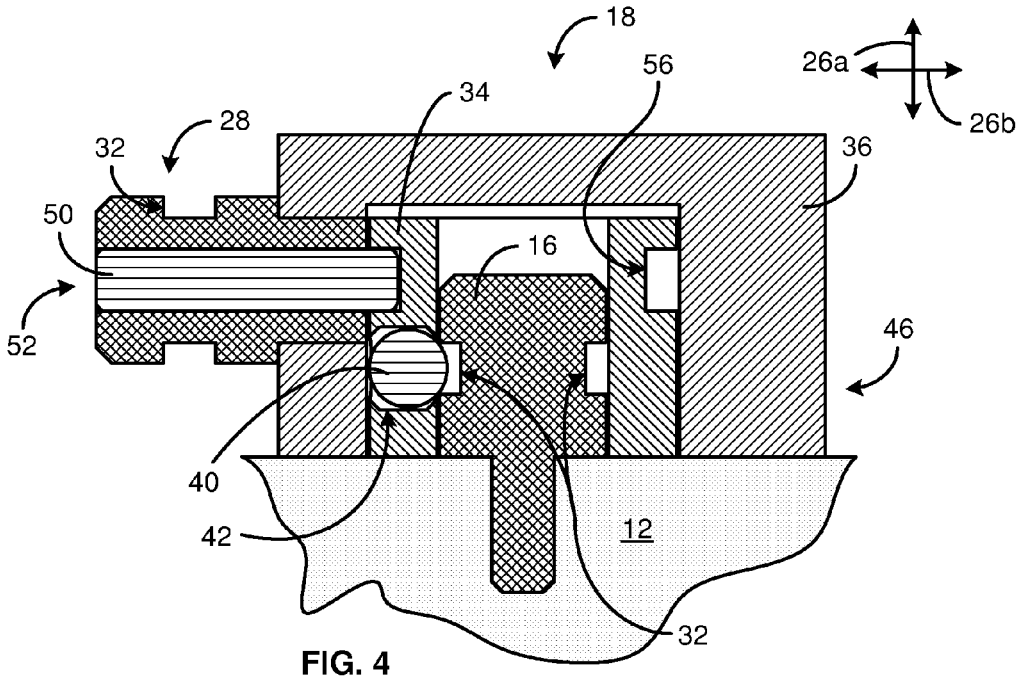
FIG. 4 is a cross-sectional view of the interface mechanism of FIG. 3 engaging an extension in accordance with the present invention with the slide in a blocking position.
Figure 5:
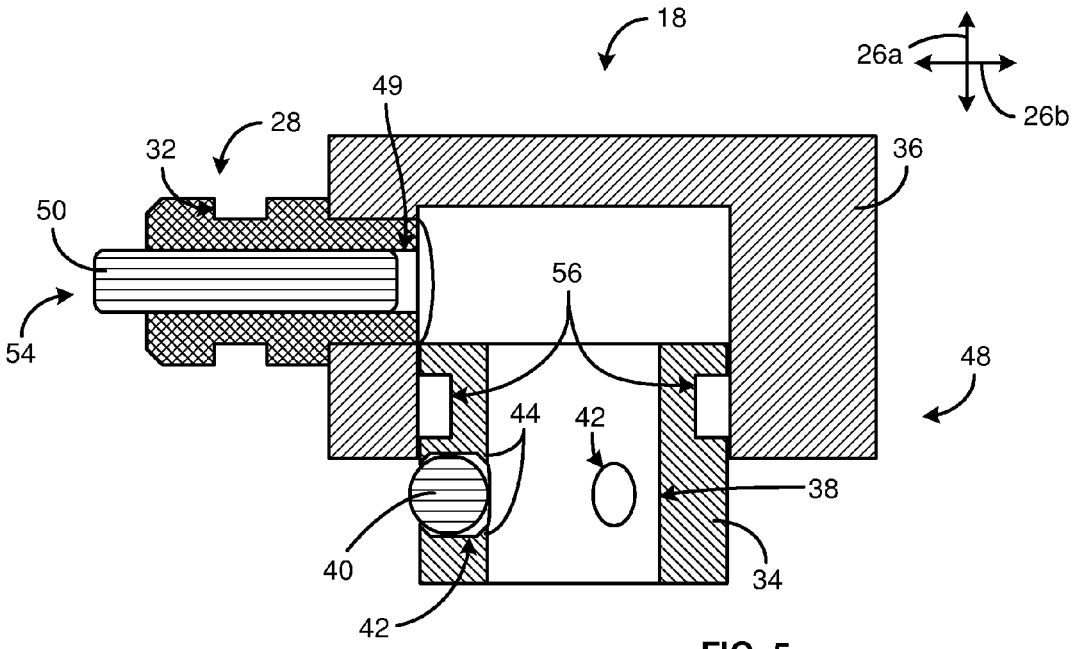
FIG. 5 is a cross-sectional view of the interface mechanism of FIG. 3 with the slide in a non-blocking position.

Referring to FIGS. 3-5, an interface mechanism 18 may include a base 34 and a slide 36. In selected embodiments, an interface mechanism 18 or portion thereof may have a cylindrical or semi-cylindrical shape and define axial, radial, and circumferential directions. For example, a base 34 or portion thereof may have cylindrical shape. Accordingly, a base 34 may be referred to as a cylindrical base. Similarly, a slide 36 or portion thereof may have cylindrical shape. Accordingly, a slide 36 may be referred to as a cylindrical slide.

In certain embodiments, a base 34 may include a first extension aperture 38 formed therein. Such an aperture 38 may be sized and shaped to receive a first extension 16 therewithin. In selected embodiments, a first extension 16 may be inserted in the axial direction (e.g., the first direction 26*a*) within a base 34.

An interface mechanism 18 may selectively secure a first extension 16 therewithin. Such securement may be accomplished in any suitable manner. In selected embodiments, an interface mechanism 18 may include one or more interference members 40. An interference member 40 may extend to engage a first extension 16 and, thereby, resist the removal of the first extension 16 from the interface mechanism 18.

In certain embodiments, a base 34 may include one or more interference apertures 42. Each interference aperture 42 may contain, or partially contain, a corresponding interference member 40. Each interference member 40 may extend from a corresponding interference aperture 42 to engage a first extension 16. For example, each interference member 40 may extend from a corresponding interference aperture 42 into a locking groove 32 of a first extension 16.

An interference member 40 may be maintained within an interference aperture 42 in any suitable manner. In selected embodiments, one or more constrictions 44 may maintain an interference member 40 in place. One or more constrictions 44 may be formed in an initial machining process, casting process, molding process, or the like. Alternatively, or in addition thereto, one or more constrictions 44 may be formed or installed in an assembly process.

For example, in selected embodiments, after an interference member 40 has been placed within a corresponding interference aperture 42, a locking ring may be installed to form a constriction 44 preventing inadvertent removal of the interference member 40 from the interference aperture 42. Alternatively, after an interference member 40 has been placed within an interference aperture 42, a portion (e.g., an opening) of an interference aperture 42 may be swaged or otherwise deformed to form a constriction 44 preventing inadvertent removal of the interference member 40.

An interface mechanism 18 may include a plurality of interference members 40 and corresponding interference apertures 42. In selected embodiments, the number of interface mechanisms 40 may be selected to distribute the loads applied thereby to a corresponding extension 16. Such distribution may lower the stress imposed on the extension 16, interference members 40, base 34, slide 36, and the like. It may also balance such loading. In selected embodiments, three interference members 40, each contained within a corresponding interference aperture 42, uniformly distributed in a circumferential direction about an extension aperture 38 may be sufficient.

An interference member 40 in accordance with the present invention may be biased toward a particular position or configuration. For example, an interference member 40 may be biased (e.g., by a spring or the like) racially inward within a corresponding interference aperture 42. Alternatively, an interference member 40 may be biased racially outward within a corresponding interference aperture 42. In still other embodiments, an interference member 40 may be unbiased and, when not confined by a slide 36, travel relatively freely within a corresponding interference aperture 42.

An interference member 40 in accordance with the present invention may have any suitable shape. For example, an interference member 40 may be spherical. Accordingly, in selected embodiments, one or more interference members 40 may comprise metal balls such as those for ball bearings.

A slide 36 may be configured to travel with respect to a base 34. For example, a slide 36 may be configured to translate in the axial direction with respect to a corresponding base 34. In selected embodiment, a slide 36 may move between one or more blocking positions 46 and one or more non-blocking positions 48. In a blocking position 46, a slide 36 may block an interference member 40 from moving out of engagement with an extension 16 (e.g., out of engagement with a locking groove 32 of a first extension 16). Accordingly, when a slide 36 is in a blocking position 46, an interface mechanism 18 may be secured to (e.g., lock onto) a corresponding first extension 16.

In a non-blocking position 48, a slide 36 may permit an interference member 40 to move within the corresponding interference aperture 42. Accordingly, with a slide 36 in a non-blocking position 48, an interference member 40 may move out of engagement with an extension 16 (e.g., out of engagement with a locking groove 32 of a first extension 16). Accordingly, when a slide 36 is in a non-blocking position 48, an interface mechanism 18 may be easily removed from a corresponding first extension 16.

A slide 36 may provide a framework for supporting one or more other components of an interface mechanism 18. For example, in selected embodiments, a second extension 28 may extend from a slide 36. A second extension 28 may connect to, or extend from, a slide 36 in any suitable manner. For example, in certain embodiments, a second extension 28 may monolithically extend from a slide 36. Alternatively, a second extension 28 may be secured (e.g., bonded, welded, bolted, threaded, or the like) to a slide 36 in an assembly process.

In selected embodiments, a second extension 28, slide 36, or both may include a traveler aperture 49 formed therein. A traveler aperture 49 may be sized and shaped to receive a traveler 50 therewithin. A traveler 50 may selectively move through a range of motion within a traveler aperture 49. In selected embodiments, a range of motion of a traveler 50 may include a locking portion and a non-locking portion. A locking portion may include one or more locking positions 52 of a traveler 50. A non-locking portion may include one or more non-locking positions 54 of a traveler 50.

A traveler 50 may be configured to translate within a corresponding traveler aperture 49. For example, a traveler 50 may translate in the second direction **26*b* between one or more locking positions 52 and one or more non-locking positions 54. In a locking position 52, a traveler 50 may extend to engage a base 34 (e.g., engage an locking aperture 56 or locking groove 56 formed within a base 34). Accordingly, when a traveler 50 is in a locking position 52, an interface mechanism 18 may be secured to (e.g., locked into) a corresponding first extension 16**.

In a non-locking position 54, a traveler 50 may permit a slide 36 to move with respect to a corresponding base 34. Accordingly, with a traveler 50 in a non-locking position 54, a slide 36 may move with respect to a base 34 until one or more interference members 40 are able to move out of engagement with a first extension 16 (e.g., out of engagement with a circumferential groove 32 of a first extension 16). Accordingly, when a traveler 50 is in a non-locking position 54, an interface mechanism 18 may be easily removed from a corresponding item 12.

A traveler 50 in accordance with the present invention may have any suitable configuration or shape. In selected embodiments, a traveler 50 may comprise one or more elements or components. For example, a traveler 50 may comprise a plurality of spherical balls. Alternatively, or in addition thereto, a traveler 50 may comprise a shaft or pin. A traveler 50 may communicate motion from one end thereof to the other. For example, one end of a traveler 50 may be positioned proximate an end of a second extension 28. An opposite end of the traveler 50 may be positioned proximate an interior of a slide 36. Accordingly, a traveler 50 may communicate motion imposed thereon at the second extension 28 to the interior of a slide 36 or vice versa.

In selected embodiments, a traveler 50 or portion thereof may cooperate with a second extension 28 to form a composite configuration, profile, or shape adapted to, or compatible with, a locking mechanism 22. Accordingly, a locking mechanism 22 may selectively engage a second extension 28, traveler 50, or both to confine, limit, or control the motion of the traveler 50.

For example, a traveler 50 and second extension 28 may form, when the traveler 50 occupies certain positions (e.g., a locking position 52), a composite configuration, profile, or shape that is compatible with a locking head described in U.S. Pat. No. 7,997,106. Accordingly, in such embodiments, when a locking mechanism 22 engages a locking groove 32 of a second extension 28, the locking mechanism 22 may contact a traveler 50 and prevent it from moving away from a base 34 (e.g., out of engagement with a locking aperture 56). As a result, a locking mechanism 22 may confine a traveler 50 to certain positions (e.g., one or more locking positions 52).

A traveler 50 may be maintained within a traveler aperture 49 in any suitable manner. In selected embodiments, one or more constrictions may maintain a traveler 50 in place. One or more constrictions (e.g., shoulders or the like) may be formed in an initial machining process, casting process, molding process, or the like. Alternatively, or in addition thereto, one or more constrictions (e.g., locking rings, deformations, or the like) may be formed or installed in an assembly process.

A traveler 50 may be biased toward certain positions within a corresponding range of motion. For example, a biasing mechanism (e.g., spring, arrangement of attracting magnets, arrangement of repelling magnets, or the like) may bias a traveler 50 toward or away from a locking position 52.

Figure 6:
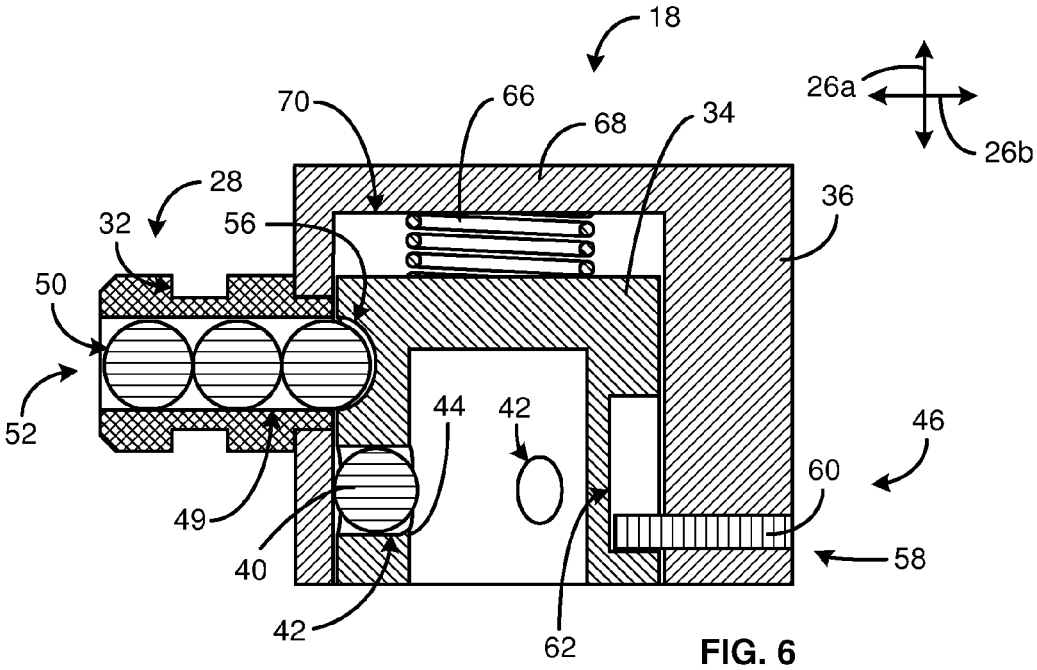
FIG. 6 is a cross-sectional view of an alternative embodiment of an interface mechanism in accordance with the present invention with the slide in a blocking position and the traveler in a locking position.
Figure 7:
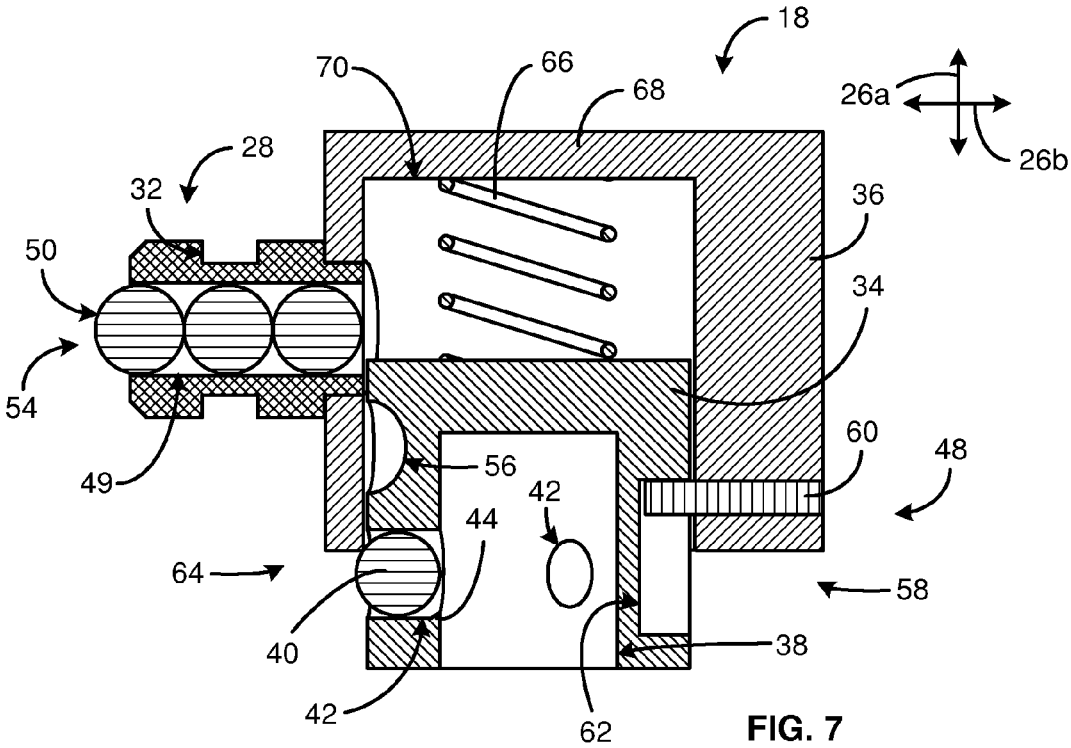
FIG. 7 is a cross-sectional view of the interface mechanism of FIG. 6 with the slide in a non-blocking position and the traveler in a non-locking position.

Referring to FIGS. 6 and 7, in certain embodiments, removal of a locking mechanism 22 from a second extension 28 may enable a slide 36 to be completely removed from a corresponding base 34. In other embodiments, it may be desirable to maintain a connection between a slide 36 and base 34 even after a locking mechanism 22 has been removed. Accordingly, in selected embodiments, an interface mechanism 18 may include one or more limiters 58.

A limiter 58 may set one or more limits on the relative motion between a slide 36 and corresponding base 34. In selected embodiments, a limiter 58 may limit rotation of a slide 36 about a base 34, translation of a slide 36 with respect to a base 34, or some combination thereof.

In certain embodiments, a limiter 58 may comprise a rider 60 and a corresponding slot 62. Relative motion between a slide 36 and base 34 may provide relative motion of the rider 60 within the slot 62. Accordingly, the shapes and sizes of the rider 60 and slot 62 may provide limits to the relative motion between the corresponding slide 36 and base 34.

For example, a rider 60 may extending from one of a slide 36 and a base 34. A slot 62 may be formed in the other of the slide 36 and base 34. The slot 62 may have a width and depth enabling the rider 60 to travel therewithin. The slot 62 may have a first end spaced in the axial direction from a second end (e.g., the length of the slot 62 may be aligned with the axial direction). Relative motion of the slide 36 with respect to the base 34 may cause the rider 60 to travel within the slot 62. Contact between a rider 60 and a first end of the slot 62 may define one limit to the axial travel of the slide 36 with respect to the base 34. Alternatively, or in addition thereto, contact between a rider 60 and a second end of the slot 62 may define another limit to the axial travel of the slide 36 with respect to the base 34. Meanwhile, contact between the rider 60 and one or more sides of the slot 62 may limit rotation of a slide 36 about a base 34.

A rider 60 may extend from a base 34 or slide 36 in any suitable manner. For example, a rider 60 may be monolithically formed as part of a base 34 or slide 36. This may be done in an initial machining process, casting process, molding process, or the like. Alternatively, a rider 60 may be formed or installed in an assembly process. For example, a rider 60 may be formed in an assembly process by inserting and securing a pin, bolt, screw, key, or the like into a slot 62, by bending or swaging some material of a base 34 or slide 36 into a slot 62, or the like.

A limiter 58 may prevent inadvertent disassembly an interface mechanism 18. A limiter 58 may also enable a slide 36 to prevent inadvertent removal of one or more interference members 40. For example, a limiter 58 may stop further motion of a slide 36 at a retaining position 64. A retaining position 64 may be a non-blocking position 48 in that, in the retaining position 64, one or more interference members 40 may be free to fully disengage a first extension 16. However, a retaining position 64 may still enable a slide 36 to prevent the one or more interference members 40 from falling out of respective interference apertures 42. Accordingly, in embodiments wherein a limiter 58 provides a retaining position 64, certain constrictions 44 of one or more interference apertures 42 may be omitted.

In selected embodiments, an interface mechanism 18 may be biased. For example, an interface mechanism 18 may include one or more biasing members 66 (e.g., springs) biasing the interface mechanism 18 toward a blocking position 46. Alternatively, one or more biasing member may bias an interface mechanism 18 toward a non-blocking position 48.

A biasing member 66 may act on slide 36, base 34, or some combination thereof in any suitable manner. For example, in certain embodiments, a slide 36 may include an end cap 68. An end cap 68 may define a cavity 70. Such a cavity 70 may extend between the end cap 68 of a slide 36 and an adjacent end (e.g., axial end) of a base 34. One or more biasing members 66 may be positioned within a cavity 70.

In selected embodiments, one or more biasing members 66 positioned within a cavity 70 may be pulled (e.g., stretched) as a slide 36 transitions from a blocking position 46 to a non-blocking position 48. Accordingly, in such embodiments, a slide 36 may be biased toward a blocking position 46. Alternatively, one or more biasing members 66 positioned within a cavity 70 may be compressed as a slide 36 transitions from a non-blocking position 48 to a blocking position 46. Accordingly, in such embodiments, a slide 36 may be biased toward a non-blocking position 48.

Figure 8:
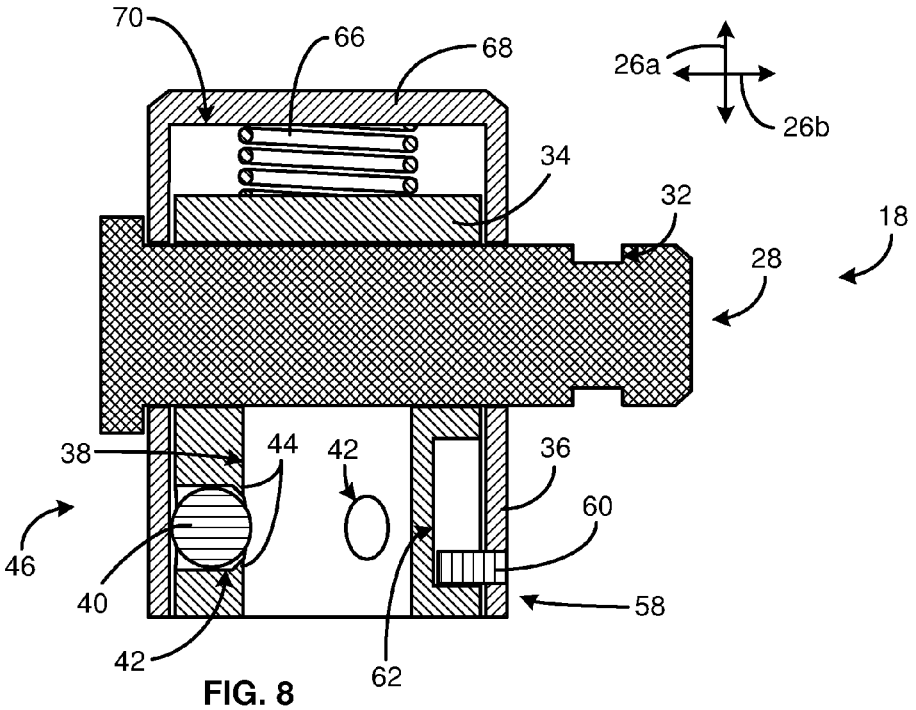
FIG. 8 is a cross-sectional view of another alternative embodiment of an interface mechanism in accordance with the present invention with the slide in a blocking position.
Figure 9:
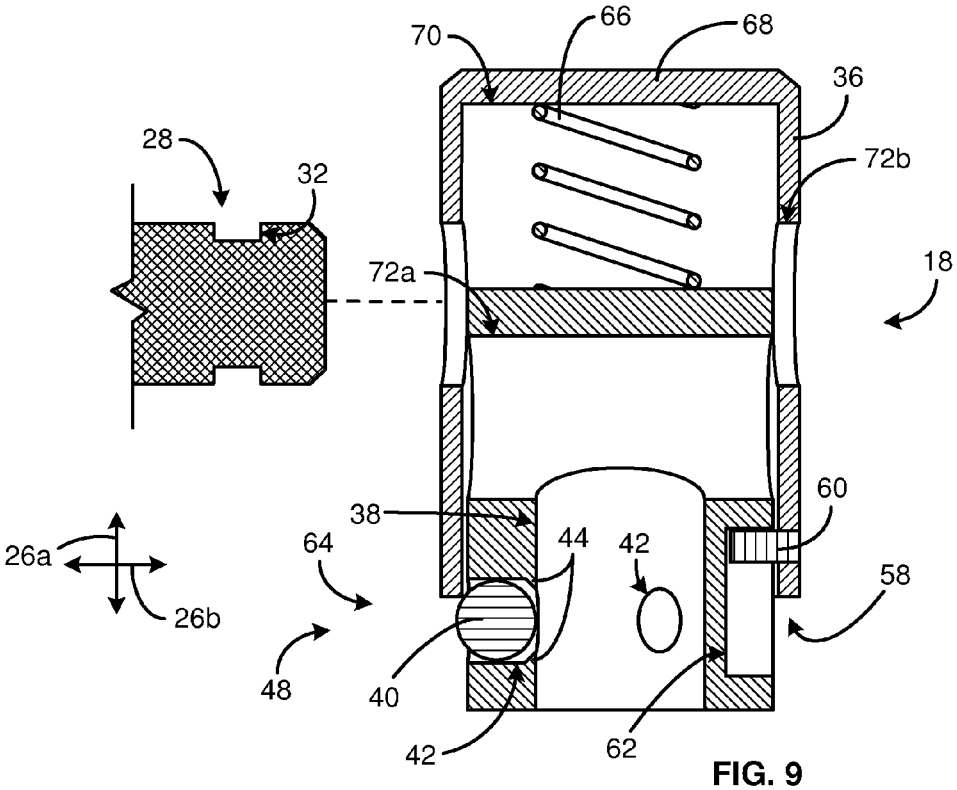
FIG. 9 is a cross-sectional view of the interface mechanism of FIG. 8 with the slide in a non-blocking position.

Referring to FIGS. 8 and 9, in selected embodiments, an interface mechanism 18 may include a second extension aperture 72. A second extension aperture 72 may extend through a base 34, a slide 36, or some combination thereof. In certain embodiments, a second extension aperture 72 may extend in a radial direction. For example, a second extension aperture 72 may extend diametrically through an interface mechanism 18.

A second extension aperture 72 may also enable a second extension 28 to secure a slide 36 with respect to a base 34. For example, a second extension aperture 72 may enable a second extension 28 to lock a slide 34 in a blocking position 46, thereby, enabling a secure connection from a first extension 16 to an interface mechanism 18 and from the interface mechanism 18 to a locking mechanism 22.

In certain embodiments, a second extension aperture 72 may comprise multiple portions 72*a*, 72*b*. A first portion 72*a* may comprise a second extension aperture formed within or through a base 34. A second portion 72*b* may comprise a second extension aperture form within or through a slide 36. When the first and second portions 72*a*, 72*b* align, a second extension 28 may be inserted therethrough and restrict relative motion between the base 34 and the slide 36. The first and second portions 72*a*, 72*b* may be configured to align when the slide 36 is in a blocking position 46. Accordingly, when inserted through the first and second portions 72*a*, 72*b*, a second extension 28 may secure a slide 36 in a blocking position 46. A locking mechanism 22 engaging an end of the second extension 28 may secure the second extension 28 within the second extension aperture 72.

Figure 10:
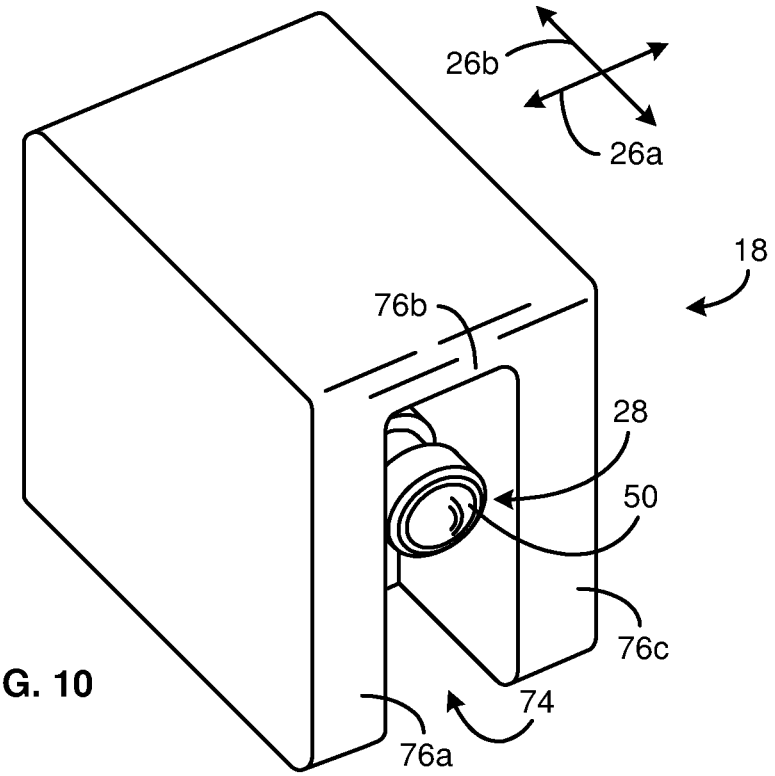
FIG. 10 is a perspective view of another alternative embodiment of an interface mechanism in accordance with the present invention.
Figure 11:
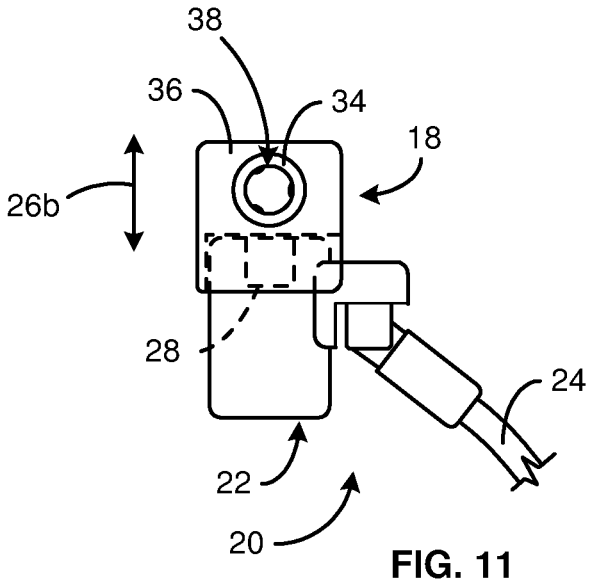
FIG. 11 is a bottom view of the interface mechanism of FIG. 10 secured to a lock.

Referring to FIGS. 10 and 11, in selected embodiments, a slide 36 may have a non-cylindrical shape. For example, a slide 36 may have a somewhat rectangular shape. Alternatively, or in addition thereto, a slide 36 may include a pocket 74, recess 74, aperture 74, or the like for receiving a lock 20 or portion thereof. For example, a slide 36 may include a pocket 74 with a second extension 28 positioned therewithin. Accordingly, a locking mechanism 22 may extend into the pocket 74 to engage the second extension 28.

A pocket 74 may have any suitable number of sides 76. For example, as illustrated, a pocket 74 may have three sides 76*a*, 76*b*, 76*c*. Alternatively, a pocket 74 may be configured one side 76, two sides 76 (e.g., opposite sides 76*a*, 76*c*), four sides 76, or the like. Certain sides 76 may be taller or shorter than other sides 76.

A pocket 74 may improve the security of the engagement between a locking mechanism 22 and a second extension 28. A pocket 74 may also limit the motion of a locking mechanism 22 with respect to a corresponding interface mechanism 18 (e.g., resist pivoting of a locking mechanism 22 about a second extension 28). Alternatively, or in addition thereto, a pocket 74 may provide a more aesthetically pleasing interface between an interface mechanism 18 and a lock 20.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An interface mechanism configured to form a connection between a first extension of an item and a lock, the first extension having a circumferential locking groove, the interface mechanism comprising:

a cylindrical base comprising an extension aperture, an interference aperture, and an interference member being positioned at least partially within the interference aperture, the extension aperture configured to receive the first extension therewithin and the interference member engages the circumferential locking groove;

a slide surrounding at least a portion of the cylindrical base, the slide configured to occupy a blocking position locking the first extension within the extension aperture; and a second extension extending from the slide and comprising a traveler, the traveler configured to occupy a locking position locking the slide in the blocking position;

wherein the lock engages the second extension and locks the traveler in the locking position.

2. The interface mechanism of claim 1, wherein the first extension extends in a first direction and the second extension extends in a second direction, orthogonal to the first direction.

3. The interface mechanism of claim 1, wherein the slide in the blocking position blocks retraction of the interference member from the circumferential locking groove.

4. The interface mechanism of claim 3, wherein the interference member is spherical in shape.

5. The interface mechanism of claim 4 further comprising a plurality of interference apertures and a plurality of interference members.

6. The interface mechanism of claim 1, wherein:

the second extension comprises a traveler aperture;

the cylindrical base comprises a locking aperture; and the traveler in the locking position extends from the traveler aperture to engage the locking aperture.

7. The interface mechanism of claim 6, wherein the lock blocks the traveler from exiting the locking aperture.

8. The interface mechanism of claim 7, further comprising an anchor and a flexible tether extending to tie the lock to the anchor.

9. The interface mechanism of claim 6, wherein the traveler aperture is cylindrical and the traveler is cylindrical, the traveler configured to axially travel within the traveler aperture.

10. The interface mechanism of claim 6, wherein the traveler aperture is cylindrical and the traveler is spherical, the traveler configured to travel within the traveler aperture.

11. The interface mechanism of claim 10, wherein a plurality of spherical travelers are positioned within the traveler aperture.

12. The interface mechanism of claim 1, wherein the slide in the blocking position blocks retraction of the interference member from the circumferential locking groove.

13. The interface mechanism of claim 12, wherein the interference member is spherical in shape.

14. The interface mechanism of claim 13, further comprising a plurality of interference apertures and a plurality of interference members.

15. The interface mechanism of claim 1, further comprising an anchor and a flexible tether extending to tie the lock to the anchor.

* * * * *